United States Patent [19]

Smilges

[11] 4,244,275

[45] Jan. 13, 1981

[54] COUNTERBALANCE VALVE

[75] Inventor: Robert Smilges, Paris, France

[73] Assignee: Abex Corporation, New York, N.Y.

[21] Appl. No.: 3,165

[22] Filed: Jan. 15, 1979

[51] Int. Cl.[3] ..... F15B 13/042

[52] U.S. Cl. ..... 91/420; 91/445; 91/447; 137/106; 137/501

[58] Field of Search ..... 91/420, 445, 447; 137/106, 501

[56] References Cited

U.S. PATENT DOCUMENTS

| | | | |
|---|---|---|---|
| 2,881,793 | 4/1959 | Lee | 137/501 |
| 3,072,107 | 1/1963 | Cassell | 91/447 X |
| 4,008,731 | 2/1977 | Katz | 91/420 X |
| 4,172,582 | 10/1979 | Bobnar | 91/420 X |

FOREIGN PATENT DOCUMENTS

| | | | |
|---|---|---|---|
| 1817822 | 1/1972 | Fed. Rep. of Germany | 91/447 |
| 1074657 | 4/1964 | France | 91/420 |
| 46-36296 | 10/1971 | Japan | 91/420 |

*Primary Examiner*—Irwin C. Cohen

*Attorney, Agent, or Firm*—Thomas S. Baker, Jr.; David A. Greenlee

[57] ABSTRACT

A hydraulic system for raising and lowering a load by means of a fluid motor includes a counterbalance valve which controls the flow of fluid to and from the motor. The counterbalance valve has a pilot operated metering orifice which passes fluid from the motor when the load is lowered and a compensator valve which maintains a fixed pressure differential across the metering orifice. This results in a fixed flow of fluid through the metering orifice when the load is lowered.

1 Claim, 3 Drawing Figures

COUNTERBALANCE VALVE

BACKGROUND OF THE INVENTION

1. Field of the Invention

This invention relates to a counterbalance valve which controls the supply of fluid to and from a fluid operated motor which raises, lowers and supports a load.

2. Description of the Prior Art

In its simplest form the function of a counterbalance valve can be achieved by a circuit which incorporates a relief valve and a check valve which are connected in parallel to the load raising side of a fluid operated motor. The relief valve is set somewhat above the maximum desired system pressure. The check valve permits the free flow of pressure fluid to the fluid motor when the load is lifted, but closes when the load is stationary or lowered. To lower the load, fluid is supplied to the load lowering side of the motor to reverse the motor so that the sum of the force of the load and the force of the fluid acting to reverse the motor exceeds the setting of the relief valve and the load is lowered. A problem with using a relief valve in paralled with a check valve is that if there is no load, fluid at a pressure above the setting of the relief valve must be supplied to drive the motor in reverse. This represents a great deal of wasted energy.

One way in which to lessen the energy lost in operating an unloaded fluid motor controlled by a relief valve in parallel with a check valve is to use a pilot operated relief valve which has an integral check valve. Such a valve has an adjustable spring, which acts on one end which has a small area of a two area spool to set the maximum system pressure. The load raising side of the motor is connected to the opposite end of the spool and the pressure fluid acts on the same area to oppose the spring. When the load is raised, fluid flows past the check valve to operate the fluid motor. When the load is lowered, a portion of the fluid in the load lowering side of the motor is directed to a pilot port connected to a larger area on the spool which acts in conjunction with the load pressure on the small area to move the spool against the spring to release the fluid from the opposite side of the motor. If there is no load on the motor, the amount of fluid pressure required to open the valve to drive the fluid motor in the load lowering direction, is the maximum system pressure divided by the ratio of the spool areas.

If the ratio of the areas is 3:1, the pressure of the fluid directed to the pilot port must be one third of the maximum system pressure set by the spring. This still represents a great deal of lost energy.

The aforementioned pilot operated relief valve is normally controlled by a four-way, open-center (all ports to tank) type valve with a throttling spool. To raise a load the valve port connected to the load lowering side of the motor and the pilot stage of the valve is opened to tank and the valve port connected to the load raising side of the motor is opened to pressure. To lower the load, the port connections are reversed.

A problem arises if it is desired to lower the load slowly. In order to lower a load slowly with an open-center throttling spool, the lever is moved such that pressure is supplied simultaneously to the load lowering side of the motor and to tank. The proportion of fluid to the load lowering side is gradually increased until the pressure fluid in the pilot stage is sufficient to move the spool and the motor can operate. If the load falls too fast, the pressure in the pilot stage falls, and the setting of the counterbalance valve is raised which stops the load from lowering. Since a pressure controlled counterbalance valve is a fast response valve, the valve starts and stops rapidly with the result that severe shocks are imposed on the hydraulic system, particularly when a heavy load is being lowered. Consequently, it can be seen that attempting to simultaneously control the pressures to a pilot operated relief valve by a four-way, open-center type valve is difficult and results in unsatisfactory operation of the relief valve when a heavy load is being lowered.

SUMMARY OF THE INVENTION

The instant invention relates to a counterbalance valve for use in a system which uses a hydraulic motor to raise and lower a load. The motor is driven in one direction to raise the load and in the opposite direction to lower the load. A four-way valve controls the flow of fluid from a pump to the motor. The counterbalance valve has a metering spool with a variable orifice which passes fluid from the motor when the load is lowered and a pressure compensator piston which maintains a fixed pressure differential across the orifice to maintain a fixed fluid flow through the metering orifice for a set metering spool position.

DESCRIPTION OF THE INVENTION

Figure 1:
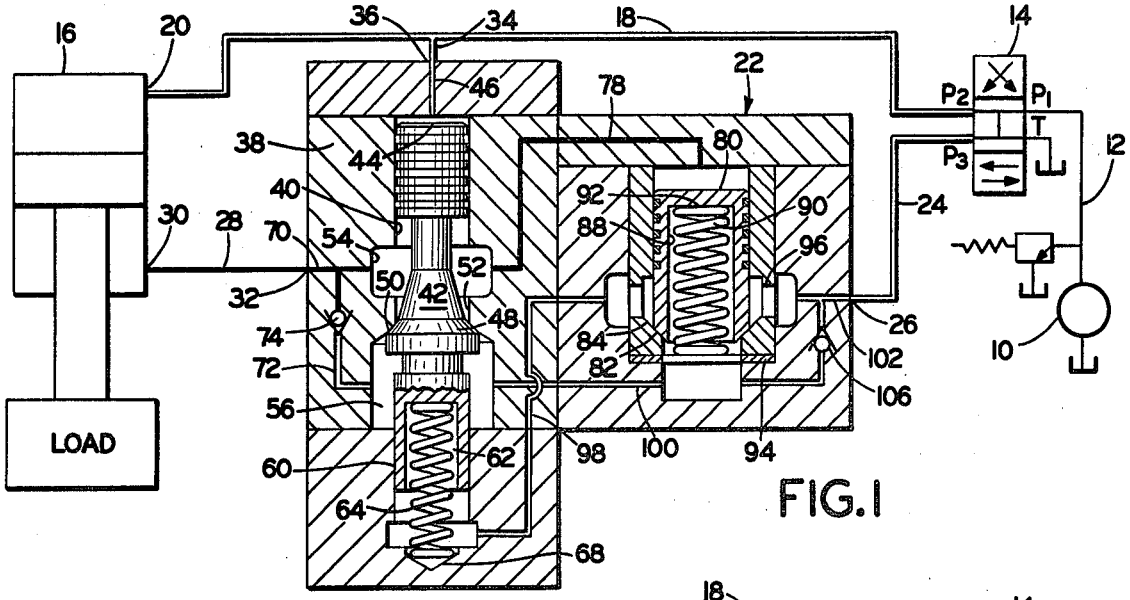
FIG. 1 shows the counterbalance valve when the fluid motor is holding the load in one position.

Referring to the drawings, a pump 10 supplies fluid under pressure through a line 12 to a port $P_1$ on one side of a four-way valve 14. The same side of the valve has a port T connected to tank. Four-way valve 14 is connected to one side of a fluid motor 16 by a fluid conduit 18 which is connected to a valve port $P_2$ and a motor part 20. Four-way valve 14 is connected to the counterbalance valve 22 of the instant invention by a fluid conduit 24 which is connected to a valve port $P_3$ and at the other end to a counterbalance valve port 26. The other end of fluid motor 16 is connected to the counterbalance valve 22 by a fluid conduit 28 which is connected to a motor port 30 and to a counterbalance valve port 32. Conduit 18 is connected to a pilot port 36 in counterbalance valve 22 by a conduit 34.

Counterbalance valve 22 has a housing 38 which defines a metering spool bore 40. A stepped metering spool 42 moves axially in bore 40. The top end 44 of spool 42 is positioned in the upper end of bore 40 which is connected to pilot port 36 through a bore 46 in housing 38. Spool 42 has a tapered center portion 48 which co-operates with a complementary surface 50 formed on the lower edge of a land 52 formed between upper and lower grooves 54, 56 in housing 38 to form a metering orifice 58. The bottom end 60 of metering spool 42 has an axial bore 62. A spring 64 is received in bore 62 and acts against the bottom 66 of bore 62 and a groove 68 in the bottom of spool bore 40 to bias spool 42 upwardly so that the tapered portion 48 of the spool cooperates with the surface 50 of land 52 to close the metering orifice 58.

Upper groove 54 is connected to valve port 32 by a bore 70. A fluid passage 72 which has a check valve 74 therein connects lower groove 56 with bore 70. Upper groove 54 is connected to a compensator piston bore 76 by a fluid passage 78.

A compensator piston 80 is axially movable in bore 76. The bottom of compensator piston 80 has a beveled edge 82 which cooperates with a complementary beveled seat 84 to form a variable orifice 86 therebetween. Piston 80 has an axial bore 88 which receives a spring 90. Spring 90 acts between the bottom 92 of bore 88 and a washer 94 to bias piston 80 upward and open orifice 86. An annular groove 96 is formed above seating surface 84. Fluid flows into groove 96 when the orifice 86 is open.

Annular groove 96 is connected to the bottom end of metering spool bore 40 by a fluid passage 98 and to valve port 26 by a fluid passage 102. The bottom of compensator bore 76, i.e., the inlet of variable orifice 86, is connected to the groove 56 below metering orifice 58 by a passage 100 and to fluid passage 102 by a conduit 104. A check valve 106 is inserted in conduit 104.

Operation of the counterbalance valve 22 when fluid motor 16 is holding a load stationary is shown in FIG. 1. In this condition, the four-way valve 14 is centered; ports $P_1$, $P_2$ and $P_3$ are connected to tank and the fluid motor 16 is not moving. The weight of the load causes fluid under pressure (which pressure depends upon the weight of the load) to be in conduit 28, upper groove 54 above metering orifice 58, and in passage 78 which is connected to compensator bore 76 on top of compensator piston 80. The high pressure fluid on top of piston 80 overcomes the force of spring 90 and causes piston 80 to engage seat 84 and close orifice 86. The high pressure fluid cannot reach the bottom of piston 80 to assist spring 90 in opening the compensator orifice 86 since check valve 74 closes passage 72 when pressure fluid is in bore 70 and metering orifice 58 is closed by spring 64. Since metering orifice 58 and compensator orifice 86 are closed, no fluid can flow out of fluid motor 16 and the load remains stationary.

Figure 2:
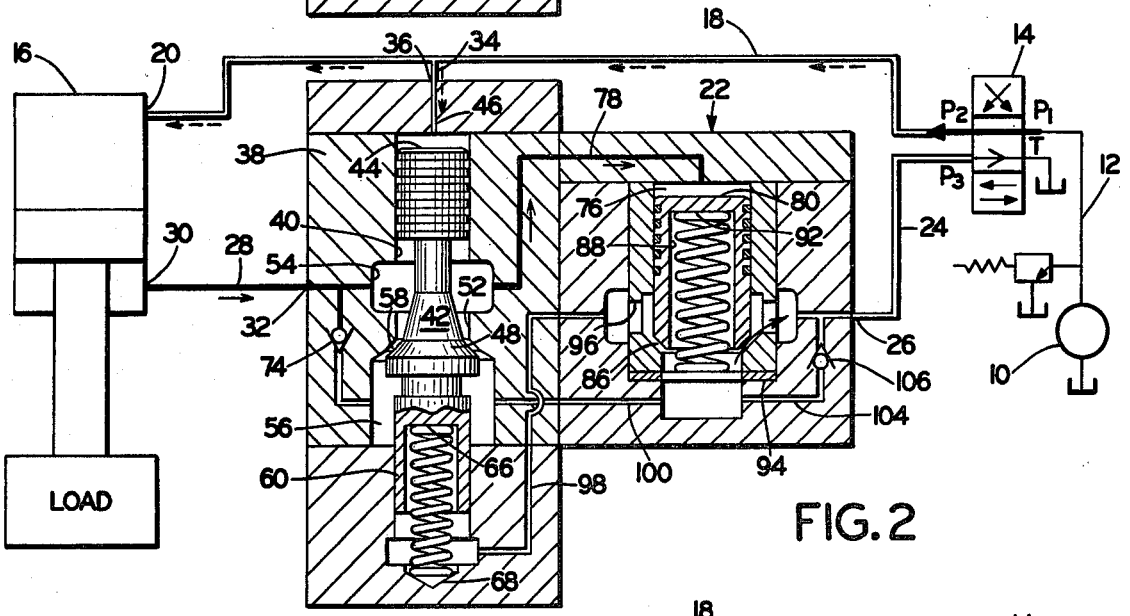
FIG. 2 shows the counterbalance valve in operation when fluid is supplied to the fluid motor to lower the load.

Operation of the counterbalance valve 22 when a load is lowered is shown in FIG. 2. When a load is lowered the four-way valve is shifted such that pressure port $P_1$ is aligned with port $P_2$ and port $P_3$ is connected to tank. Pressure fluid, which can be at a relatively low pressure (i.e., between 100 and 300 pounds per square inch), from line 12 flows into line 18, into port 20 at one end of fluid motor 16 and into the pilot port 36 in the counterbalance valve 22. From port 36 the pressure fluid flows through bore 46 to act against the top end 44 of metering spool 42 to overcome spring 64 and open metering orifice 58. As orifice 58 is opened, the high pressure fluid in upper groove 54 from line 28 which is connected to the load side of the motor 16 flows through metering orifice 58 to groove 56 and through passage 100 to the bottom of compensator piston 80. When the sum of the pressure on the bottom of the piston 80 and the force of spring 90 are sufficient to overcome the force of the high pressure fluid from passage 78 acting on top of piston 80 and lift the piston 80 off of seat 84, orifice 86 is opened and fluid from the motor flows through the orifice 86, annular groove 96, passage 102 and line 24 to tank. Consequently, the load begins to lower.

As mentioned above, when the load is lowered, fluid which is exhausted from the motor 16 flows through metering orifice 58. Since a pressure drop is created as fluid flows through the orifice 58, fluid at a reduced pressure acts on the bottom of piston 80. As the rate of descent of the load increases, fluid flows through metering orifice 58 at an increased rate and the pressure drop across orifice 58 increases. If the pressure drop becomes too great, the sum of the force of the pressure of the fluid on the bottom of compensator piston 80 and the force of spring 90 are not sufficient to overcome the force of the pressure fluid on top of piston 80 and compensator piston 80 moves toward seat 84 to reduce the compensator orifice 86 and thereby reduce the fluid flow through orifice 58. As the fluid flow through metering orifice 58 decreases, the pressure drop across the orifice 58 decreases and compensator orifice 86 opens. In this way compensator piston 80 maintains the pressure drop across orifice 58 equal to the force of spring 90, the flow of fluid through the metering orifice 58 and out of motor 16 is controlled and the motor 16 cannot overspeed as the load is lowered.

Figure 3:
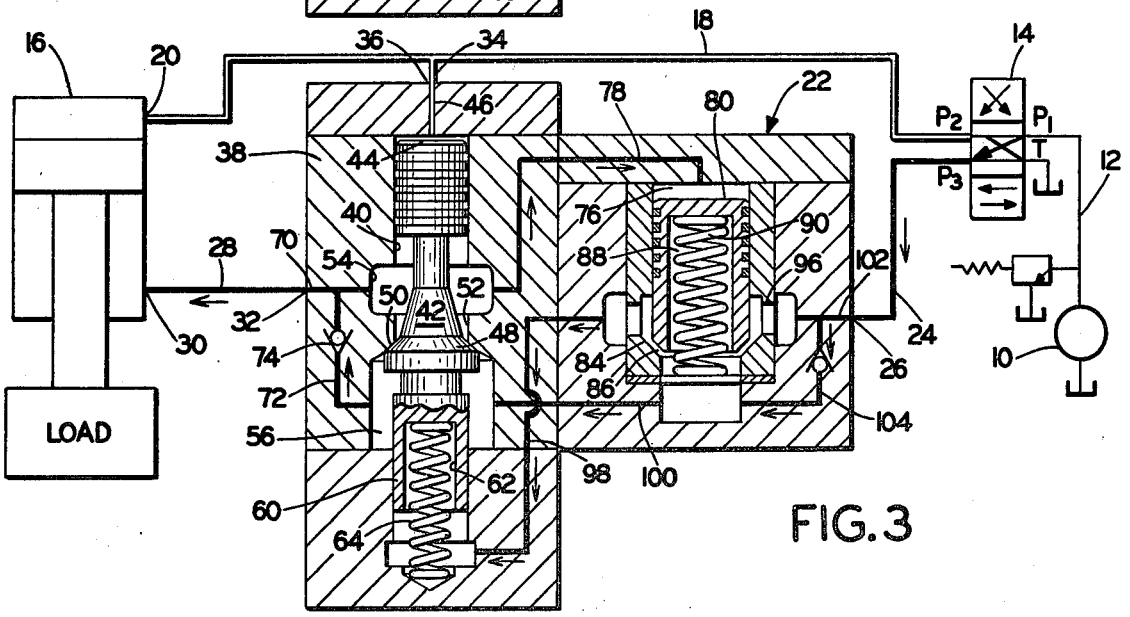
FIG. 3 shows the counterbalance valve in operation when fluid is supplied to the fluid motor to raise the load.

The operation of counterbalance valve 22 when a load is raised is shown in FIG. 3. When a load is raised the four-way valve 14 is shifted such that pressure port $P_1$ is aligned with port $P_3$ and port $P_2$ is connected to tank. High pressure fluid from line 12 flows into line 24, into counterbalance valve port 26 and into fluid conduits 102 and 104. Fluid in line 102 flows through annular groove 96 around the compensator piston 80 and into line 98 which terminates at the bottom of metering spool 42. The high pressure fluid acts in conjunction with spring 64 to bias spool 42 upwardly to thereby close the metering orifice 58. Fluid in line 104 flows through check valve 106 into the bottom of compensator piston 80 and into passage 100 which opens into groove 56 beneath metering orifice 58. The fluid flows from groove 56 into fluid passage 72, through check valve 74 and into bore 70. From bore 70 the fluid passes through valve port 32 into line 28 which is connected to motor port 30. In this way, fluid is supplied to operate the motor to raise the load.

Fluid in bore 70 also flows into upper groove 64 and fluid passage 78 which terminates above compensator piston 80. Consequently, when the load is raised the compensator piston is unseated by spring 90 since the fluid pressures on top and beneath the piston are equal. It does not matter if the compensator piston 80 is unseated when the load is raised, since the primary purpose of the compensator piston 80 is to control the rate of flow of fluid to metering orifice 58 when the load is lowered.

Fluid exhausted from the motor 16 flows through motor port 20, line 18 and valve 14 to tank.

Although a preferred embodiment of the invention has been illustrated and described, it will be apparent to those skilled in the art that various modifications may be made withour departing from the spirit and scope of the present invention.

I claim:

1. A hydraulic system for raising and lowering a load including a hydraulic motor operable in one direction to raise the load and operable in the opposite direction to lower the load, a pump which supplies pressure fluid to operate the motor, a four-way valve alternatively movable between a first position which connects the pump output to one side of the motor to raise the load, a second position which connects the pump output to the other side of the motor to lower the load and a neutral position in which the pump output is routed to tank and the hydraulic motor is stationary, characterized by a remote, pilot-operated counterbalance valve connected between the four-way valve and the hydraulic motor, which valve comprises a metering spool, a variable metering orifice which passes fluid from the motor when the load is lowered, means biasing the metering spool to close the metering orifice, a pilot fluid conduit connected between one end of the metering spool and the unloaded side of the motor, wherein pressure fluid in said pilot fluid conduit moves the metering spool to open the metering orifice when the load is lowered, a pressure compensator valve which comprises a pressure compensator spool, means for connecting the pressure compensator spool to the upstream and downstream sides of the metering orifice, a compensator spool seat and the compensator spool cooperates with the compensator spool seat to form a compensator orifice which receives fluid from the metering orifice and the pressure compensator valve maintains a fixed pressure differential across the metering orifice to thereby maintain a fixed fluid flow through the metering orifice when the load is lowered, including means for hydraulically closing the compensator orifice when the hydraulic motor is stationary.

* * * * *